United States Patent [19]

Mäkelä

[11] Patent Number: 4,956,050

[45] Date of Patent: Sep. 11, 1990

[54] METHOD FOR ATTENUATION OF THE MACHINE DIRECTION PRESSURE PULSATIONS IN THE HEADBOX IN PAPER AND BOARD MACHINES

[75] Inventor: Olavi Mäkelä, Kyminlinna, Finland

[73] Assignee: Velmet-Ahlstrom Inc., Karhula, Finland

[21] Appl. No.: 322,697

[22] Filed: Mar. 13, 1989

[30] Foreign Application Priority Data

Mar. 28, 1988 [FI] Finland ..... 881453

[51] Int. Cl.[5] ..... D21F 1/06

[52] U.S. Cl. ..... 162/198; 162/216; 162/259; 162/336

[58] Field of Search ..... 162/336, 339, 212, 216, 162/258, 259, 262, 263, 380, 198

[56] References Cited

U.S. PATENT DOCUMENTS

| | | | |
|---|---|---|---|
| 3,547,775 | 12/1970 | Bossen et al. | 162/336 |
| 3,649,446 | 3/1972 | Makela | 162/212 |
| 4,146,052 | 3/1979 | Bubik et al. | 162/343 |
| 4,384,922 | 5/1983 | Stotz | 162/259 |

FOREIGN PATENT DOCUMENTS

| | | | |
|---|---|---|---|
| 2459495 | 7/1976 | Fed. Rep. of Germany | 162/259 |
| 3514554 | 3/1986 | Fed. Rep. of Germany | 162/336 |
| 636314 | 12/1978 | U.S.S.R. | 162/259 |

*Primary Examiner*—Karen M. Hastings

*Attorney, Agent, or Firm*—Cohen, Pontani & Lieberman

[57] ABSTRACT

The invention relates to a method of active attenuation of machine directon pressure pulsations in the stock fed into the headbox (10) of a paper or board machine in such a way that the pressure pulsations in the stock are measured and the water flow to be fed into the stock is controlled on the basis of the results of the measurement. The volume available for the stock flow is controlled by means of water flow changes. Pressure variations achieved by volume variations are arranged substantially in opposition to the pressure variations to be attenuated thus attenuating the pressure variations in the stock. The invention also relates to an apparatus for carrying out the above method. The apparatus comprises a sensor (6) or a set of sensors, on the basis of whose output signal/signals a regulator (7) has been arranged to automatically control the water flow to be fed into the stock by an adequately fast valve arrangement (1) moved by the controlling element (2) of the regulator (7).

6 Claims, 1 Drawing Sheet

METHOD FOR ATTENUATION OF THE MACHINE DIRECTION PRESSURE PULSATIONS IN THE HEADBOX IN PAPER AND BOARD MACHINES

The invention relates to a method of active attenuation of the pressure pulsation in the stock fed into the headbox of a paper or board machine.

The invention also relates to an apparatus for carrying out the method according to the invention.

The background and purpose of the present invention and the mechanisms of formation if disturbances in the solids flow in the approach piping of the stock system in a paper machine are first discussed in general terms. Conditions are ideal as regards the disturbances when, at each length unit of the slice of the headbox, an equal quantity of dry material continuously flows out at a constant velocity per time unit. If the flow is the same across the total width of the slice, but varies in relation to time, basic weight variations in the machine direction are caused. It is the main object of the present invention to provide a method and an apparatus by means of which the variations can be attenuated more effectively and economically than by prior methods.

If the stock flow is constant in relation to time, but varies at different points across the width of the paper machine, cross direction variations in the basic weight are produced. These variations cannot be attenuated by the attenuating systems in the approach piping of the stock system. As known, the adjustment of the profile is achieved by means of the fine-regulating spindles of the slice lip.

If the stock flow is independent of time simultaneously measured at the whole of the slice and, furthermore, the same on the average at each point of the width of the paper machine observed over a prolonged period of time, but varies momentarily, random heavier and lighter points, or so called remnant variations, are caused. The latter variations are caused first of all by the influence of the turbulence formed in the headbox on the outlet flow and secondly by the small-scale unevenness of solids distribution in the stock.

The turbulence mentioned above cannot be attenuated by attenuation systems according to the invention or any other system placed in the approach piping. The problem in question can be influenced by the design of the headbox, whereas it is the object of the solution according to the invention to reduce the above mentioned small-scale unevenness of solids distribution in the stock more economically than, or at least as effectively as the best of the known solutions do.

The above mentioned basic weight variations in the machine direction are mainly caused, firstly, by variations in the volume flow of the stock in the inlet pipe to the headbox, secondly, by the pressure waves proceeding at sonic speed, always present in the inlet pipe, which at the slice are changed into variations in the kinetic energy of the jet, and thirdly, by large-scale variations in the consistency of the stock in the said inlet pipe.

In short, the input disturbance signal dealt with by the invention can be described to be the dynamic pressure variation at the slice, and the output disturbance signals are the hydrostatic pressure variation in the piping, the variation in the pressure fed by the pump, the variations in the pressure loss during the process, the impulse pressures caused by the pulsation transmitted to the piping through its supporting structure and the variations of pressure in the piping caused by turbulence, especially at valves, elbows of the pipes, etc. In practice it has been observed that each of the various disturbance signals has their own characteristic, often very wide, frequency spectrum. However, clearly observable peaks at frequencies corresponding with those of the speed of rotation of the pumps and its multiples and subharmonics characterize for example the spectra of the disturbance signals of the pumps. In practice, detrimental pulsations exist in the frequency range of 1–50 Hz, the amplitudes of the pulsations being in the range of 1–20 mbar (=1–20 cm $H_2O$).

A previously known solution for attenuating the pressure pulsation in the headbox of a paper machine has been disclosed in the U.S. Pat. No. 3,649,446, in which the volume of the headbox is changed according to the pressure variations in order to achieve the desired pressure, and in which there is an air space.

U.S. Pat. No. 4,146,052 discloses a previously known solution for an attenuation system for pressure disturbances in the stock flow of a paper machine. The apparatus according to the patent in question comprises a housing having a chamber and a transition section with a perforated plate in the housing at the downstream end of the transition section. This plate extends across the entire cross-section of the transition section and has a number of ducts, each of which has a series of flow sections of step-wise increasing cross-sectional area in the direction of liquid flow. The attenuation of the pressure disturbances is obtained through the co-operation of the transition section and the perforated plate.

FI patent 57281 discloses a solution for a system for attenuating pressure variations in the stock flow of a hydraulic headbox of a paper machine, in which the inlet header and/or the equalizing chamber communicate with an air container through a flexible wall, which can vibrate under the influence of the pressure variations and which is parallel with the direction of the stock flow at this point.

FI patent 57282 also discloses an apparatus for damping pressure disturbances in the stock flow, which is meant to be placed in the approach piping of the stock. This apparatus is equipped with a closed air space and a closed container having a flow duct running through it, whose walls are of flexible, membrane-like material allowing it to vibrate under the influence of pressure disturbances, which on one side is in immediate communication with the air space of the container.

One further previously known apparatus to be placed in the approach piping of a hydraulic headbox of a paper machine for attenuation of pressure and flow disturbances is disclosed in FI patent 58955. The apparatus according to this patent comprises a container, an air chamber and a chamber for the stock flow within it, which are in communication with each other by means of a flexible membrane-like wall.

The previously known headboxes are of three main types:

(a) those equipped with an air cushion built directly in connection with the headbox, the so-called air cushion headboxes.

(b) hydraulic headboxes equipped with air cushions separate from the headbox, where the air containers are located either in the approach piping before the inlet header or after it and (c) hydraulic headboxes without any air cushions The purpose of the air cushions is to equalize pressure variations occurring in the stock flow before the slice or the discharge opening, which may either originate from the stock system before the headbox or from the headbox itself.

In an air cushion-type headbox according to point (a) the attenuation of said transient pressure variations is usually quite effective, as the area of the stock flowing against the air cushion is relatively large and the height of the stock space measured transversely to the direction of the flow relatively low. These headboxes have another advantage, namely that the air cushion usually extends very close to the slice of the headbox, so there is little risk for new pressure variations to arise in the area left between the air cushion and the slice lip.

In spite of the advantages described above, the air cushion-type headboxes have lately often had to give way to hydraulic or fully hydraulic headboxes mentioned in points (b) and (c) where the newest, fast paper machines are concerned, the reason being the easier fitting in of the latter in connection with the twin wire formers and, on the other hand, the lower production costs. The greater turbulence of the stock jet coming from the slice and the more favourable distribution of the turbulence intensity plus the consequently better homogenity of the stock have also been in favour of adopting the hydraulic headboxes.

To counter-act the advantages mentioned above, the hydraulic headboxes have displayed difficulties caused by the pressure variations described earlier. Often an originally fully hydraulic headbox has been fitted with one or several separate air containers to act as the air cushion of an air cushion-type headbox. Various solutions are known for placing the separate air containers, in some of which the air containers have been conected to the stock piping before the headbox, and in others mounting them above the headbox itself and connecting them by pipes or ducts with the upper section of the headbox.

The latter solution has, however, a drawback, namely that with an air container disposed above the headbox the height of the free surface of the liquid from the central axis of the liquid flow becomes great or that the connection pipes or duct leading from the headbox into the air container has to be dimensioned narrow in relation to the main flow duct. In both cases the attenuation capacity is considerably reduced compared with the attenuation capacity of a normal air cushion-type headbox.

It is the main object of the invention to provide an active attenuator which eliminates the pressure variations present in the stock and which can replace the attenuation chamber of the headbox and its air space in order to dispense with the air space. the invention can be carried out with a construction that is simpler and cheaper to produce than previously known constructions.

The invention is based on the fact that the coefficient of elasticity of a liquid is very great. For example, changing the volume of pure water by 1% changes the pressure of the water within this volume by approximately 200 bar. The change of pressure in the stock is not quite this great, as stock always contains small quantities of air. On a practical level the change of volume of the stock by 1% probably means a change of the pressure by about 20 bar. In the method according to the invention, the volume available for the stock is changed by means of water fed into the stock. The water flow is very rapidly changed and consequently the volume available for the stock also changes very rapidly. By controlling the water flow in a suitable way it is thus possible to eliminate the pressure variations present in the stock. The quantity of water needed is very small; even a change of volume of one thousendth of one percent will cause the 20 mbar-pressure change needed for the elimination of pressure pulsation. In practice somewhat larger quantities of water will be needed, for the piping does not entirely correspond to a completely closed vessel. In practice the suitable quantity of water for a stock flow of 10,000 l/min is 1–10 l/min. This quantity of water has no practical bearing on the consistency of the stock.

The invention is mainly characterized in that the method comprises a combination of the following steps:

(a) (a) the pressure pulsation in the stock is measured;

(b) a water flow to be fed into the stock is controlled on the basis of the results of the measurement according to step (a);

(c) the available volume of the stock flow is controlled by the variations in the water flow achieved by the control according to step (b);

(d) pressure variations are achieved by volume variations according to step (c), the pressure variations being arranged substantially in opposition in relation to the pressure variations to be attenuated thus attenuating the pressure variations in the stock.

Further preferred features of the method according to the invention include a method wherein a least one of the feeding and the varying of the volumetric flow of water into the stock is carried out in a timed relation to the measured pressure pulsations so that the pressure variations produced thereby in the stock attenuate the pressure pulsations. The present invention also includes a method wherein the pressure pulsation attenuated by the method have an energy spectrum primarily in the frequency range of 1 to 50 Hz.

The apparatus for carrying out the method according to the invention is characterized in that the apparatus comprises a pressure sensor or a corresponding set of sensors, on the basis of whose output signal/signals a regulator has been arranged to automatically control the water flow to be fed into the stock by element of the regulator.

Further advantageus features of the apparatus according to the invention includes an apparatus for actively attenuating machine direction pressure pulsations in stock fed into a headbox of a paper machine comprising pressure sensing means for measuring pressure pulsations in the stock; a supply of water; means for selectively feeding a flow of water from the supply to the stock; and means for varying the volumetric flow of water from the supply to the stock in accordance with the pressure pulsations measured by the pressure sensing means so as to produce in the stock pressure variations in machine direction and in out-of-phase relation to the measured pressure pulsations and thereby attenuate the pressure pulsations.

The invention is described in detail in the following, with references to some embodiments of the invention shown in the figures in the enclosed drawings, which, however, by no means limit the invention.

Figure 1:
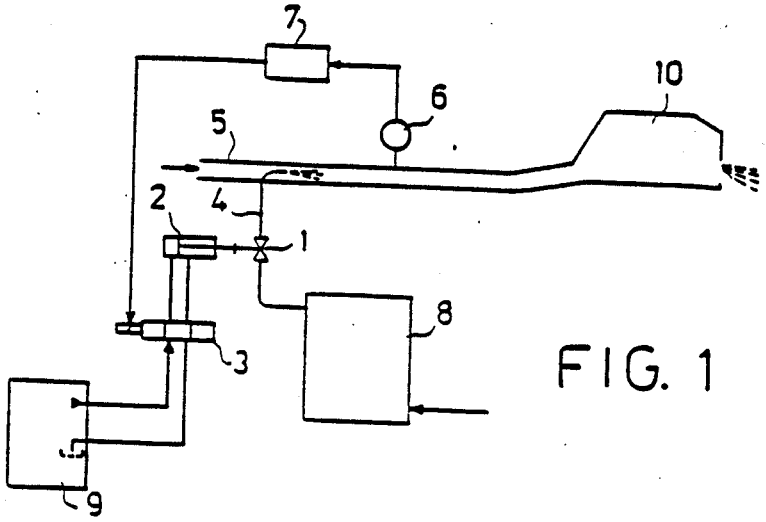
FIG. 1 shows a schematic view of an apparatus according to the invention.

In the apparatus according to FIG. 1 the pressure pulsation in the stock flowing into a headbox 10 through a stock pipe 5 are measured using an adequately fast and sensitive pressure sensor 6 or by corresponding means. Pressure sensor 6 sends a signal to an electronic regulator 7, which transforms from the signal of pressure sensor 6 a signal to be fed into a hydraulic servo valve 3. Via electronic regulator 7 the signal is sent further to hydraulic servo valve 3, which controls the position of the piston of a hydraulic controlling element 2. The piston of hydraulic controlling element 2 moves the spindle of a valve 1 so that the throttling of valve 1 changes according to the position of the spindle. Valve 1 controls the water flow fed into the stock from a pressurized water container 8 via a pipe 4 into stock pipe 5, the direction of the flow being from the outside to the inside of headbox 10.

The measuring point of pressure sensor 6 is preferably located somewhat closer to headbox 10 than the distance between the feeding point and pipe 4.

The signal given by regulator 7 to controlling element 2 via servo valve 3 controls valve 1 via controlling element 2 in the way that the water flow introduced via valve 1 along pipe 4 into the stock in pipe 5 changes the volume available for the stock and thus also the pressure in the way that the pressure pulsations are eliminated.

Figure 3:
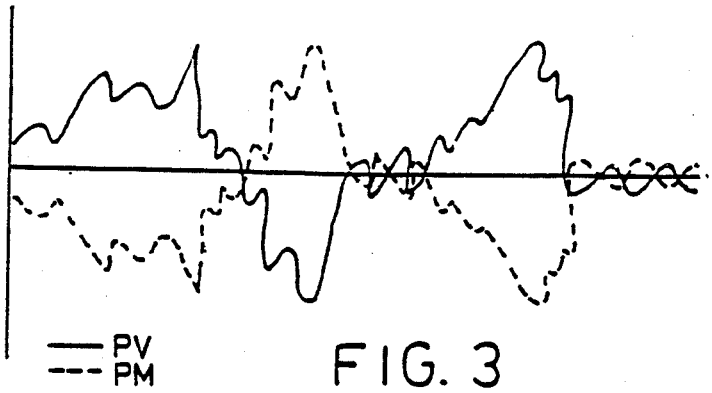
FIG. 3 shows in the form of a chart the elimination of the pressure variations by means of anti-phase change of pressure.

While transforming the signal from pressure sensor 6, electronic regulator 7 also takes into account the delays caused by various controlling elements and the differences in speeds and distances of the stock and water flow, so that the change in the volume available for the stock caused by the change in the water flow cause a pressure change which eliminates the pressure pulsation. FIG. 3 shows an example of how pressure pulsation PV is eliminated by an anti-phase pressure change PM.

Valve 1 is controlled very rapidly, and consequently servo valve 3 and the controlling element also function sufficiently fast, at a speed of approximately 50 Hz, the distance of travel being very short, approximately ±1 mm.

The water to be fed into the stock in pipe 5 via pipe 4 and valve 1 is pumped into a pressure tank 8, which has a constant pressure. The pressure in pressure tank 8 is preferably about 20–30 bar.

The pressure oil for hydraulic servo valve 3, which controls controlling element 2, is supplied by a hydraulic aggregate 9.

Pipe 4 between valve 1 and stock pipe 5 is sufficiently short for changing the speed of the flow sufficiently fast in order to eliminate the pressure pulsation.

Figure 2:
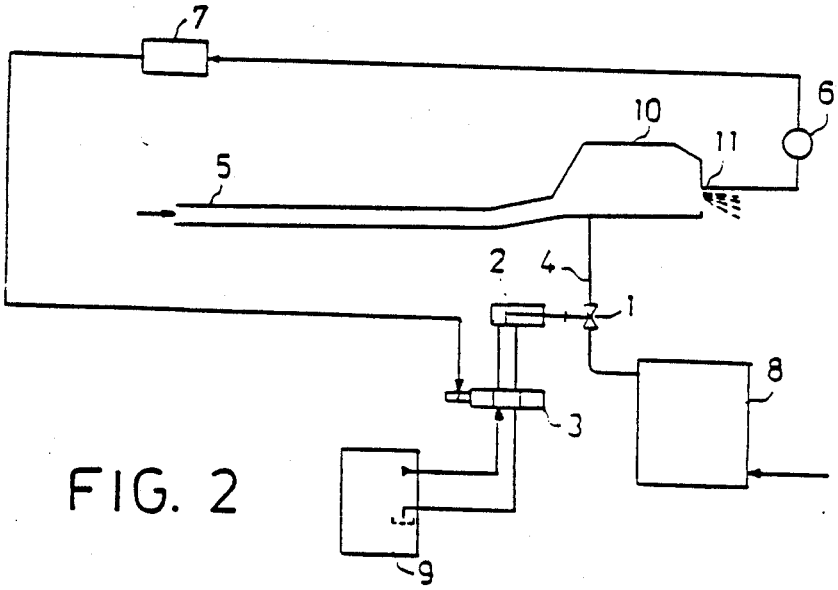
FIG. 2 shows a schematic view of another embodiment of the apparatus.

FIG. 2 shows another embodiment of the invention, where the pressure pulsations are measured using pressure sensor 6 for instance from slice 11 of headbox 10. The signal from pressure sensor 6 goes via regulator 7, which transforms the signal, to servo valve 3, which controls the piston of controlling element 2, which in turn moves the spindle of valve 1 in the way that the throttling of valve 1 changes according to the position of the spindle. Valve 1 controls the water flow fed into the stock in headbox 10 from pressure tank 8 through pipe 4.

In the solution according to this embodiment the water flow is fed into headbox 10 through one or preferably several pipes. Pipes 4 are preferably placed in parallel at suitable intervals transverse to the direction of the stock flow. The measurement of the pressure pulsation is however carried out using only one sensor 6.

While the invention has been described with reference to certain preferred embodiments thereof, it will be appreciated by those skilled in the art that the invention is not limited to these precise apparatus, and that changes may be made herein without departing from the scope of the invention, which is defined in the appended claims.

What is claimed is:

1. A method of attenuating machine direction pressure pulsations in stock fed into a headbox of a paper machine comprising the steps of:

(a) measuring machine direction pressure pulsations in the stock;

(b) feeding a water flow into the stock;

(c) varying said water flow relative to said pressure pulsations measured in step (a);

(d) controlling the available volume of stock flow by said varying water flow; and (e) causing pressure variations by said volume variations in said stock flow, said pressure variations being in out-of-phase relation to said machine direction pressure pulsations measured in step (a), thereby attenuating said pulsations primarily in the frequency range of 1 to 50 Hz.

2. A method in accordance with claim 1, wherein said variable flow of water is fed into a conduit through which the stock is fed to the headbox.

3. A method in accordance with claim 1, wherein said variable flow of water is fed into the headbox.

4. A method in accordance with claim 1, wherein said pressure pulsations in the stock are measured at a conduit through which the stock is fed to the headbox.

5. A method in accordance with claim 1, wherein said pressure pulsations in the stock are measured at the headbox.

6. A method in accordance with claim 1, wherein said pressure pulsations in the stock are measured at the headbox slice.

* * * * *